US008153221B1

(12) United States Patent
MacKinnon

(10) Patent No.: US 8,153,221 B1
(45) Date of Patent: Apr. 10, 2012

(54) ADHESIVE DEVICE FOR SECURING CLOTHING

(75) Inventor: Debra MacKinnon, Spring Lake, NJ (US)

(73) Assignee: Runberg, Inc., Spring Lake, NJ (US)

( * ) Notice: Subject to any disclaimer, the term of this patent is extended or adjusted under 35 U.S.C. 154(b) by 293 days.

(21) Appl. No.: 12/497,209

(22) Filed: Jul. 2, 2009

Related U.S. Application Data

(60) Provisional application No. 61/077,637, filed on Jul. 2, 2008.

(51) Int. Cl.

| | |
|---|---|
| ***B32B 9/00*** | (2006.01) |
| ***B32B 33/00*** | (2006.01) |
| ***A41C 1/06*** | (2006.01) |
| ***A41C 3/00*** | (2006.01) |
| ***A41D 27/26*** | (2006.01) |

(52) U.S. Cl. ..... 428/40.1; 428/343; 428/354; 450/7; 450/14; 450/30; 450/81; 450/86; 2/460; 2/461

(58) Field of Classification Search ..... 428/40.1, 428/42.2, 343, 354; 450/7, 14, 30, 81, 86; 2/459–461, 220, 305, 265, 266; 24/67 AR, 24/114.6

See application file for complete search history.

(56) References Cited

U.S. PATENT DOCUMENTS

| | | | | |
|---|---|---|---|---|
| 2,633,440 | A * | 3/1953 | Scholl | 428/40.1 |
| 3,042,983 | A | 7/1962 | Riedler | |
| 3,947,896 | A | 4/1976 | Taylor | |
| 5,006,393 | A * | 4/1991 | Isoe | 428/137 |
| 5,309,608 | A | 5/1994 | Lucas | |
| 5,802,612 | A | 9/1998 | Hosking | |
| 6,572,945 | B2 | 6/2003 | Bries et al. | |
| 2004/0170792 | A1 | 9/2004 | Roberts | |
| 2007/0044198 | A1 | 3/2007 | Whicker | |

OTHER PUBLICATIONS

U.S. Trademark Reg. No. 3,176,846, registered on Nov. 28, 2006.
"Privacy Strips the Shirt Gap Solution™", retrieved from http://www.privactystrips.com/ on Jul. 18, 2008.
"Privacy Strips, LLC—About Us", retrieved from: http://www.alibaba.com/member/privacy101/aboutus.html.
"Hollywood Fashion Tape", retrieved from http://hollywoodfashiontape.com/products_tape.cfm.

* cited by examiner

*Primary Examiner* — Patricia Nordmeyer
(74) *Attorney, Agent, or Firm* — McDermott Will & Emery LLP

(57) ABSTRACT

An adhesive device for securing clothing is provided. The adhesive device includes a flexible substrate having opposing faces. Each opposing face has an adhesive deposited thereon forming a first adhesive surface and an opposing second adhesive surface. An aperture is formed in a central portion of the adhesive device.

16 Claims, 5 Drawing Sheets

ADHESIVE DEVICE FOR SECURING CLOTHING

RELATED APPLICATION

This application claims the priority of U.S. Provisional Application No. 61/077,637, filed Jul. 2, 2008, the entire contents of which are incorporated herein by reference.

FIELD OF THE DISCLOSURE

This disclosure relates to adhesive devices for securing clothing, and in particular for sealing gaps between shirt buttons.

BACKGROUND OF THE DISCLOSURE

Clothing securing devices allow two pieces of clothing to adhere to each other. Clothing securing devices can allow a proper fit to be obtained. Some clothing securing devices comprise a plurality of adhesive tape portions connected to each other by a rigid plastic connector. The rigid plastic connector can be formed of polyvinyl chloride (PVC). The rigid adhesive devices do not conform to stretch fabrics. In addition, PVC based clothing securing devices are bulky and not transparent, and thus are visible and unsightly. Other clothing securing devices comprise adhesive tapes with a notch cut into a length side of the tape, to allow the tape to be positioned around a button. An example of an other clothing securing device comprising a shirt closure strip 10, adhesive portions 12 a notch 16 formed along the length side 18, with a plastic connecting portion 14 without adhesive is illustrated in FIG. 1.

SUMMARY OF THE DISCLOSURE

According to an embodiment of the present disclosure, an adhesive device for securing clothing comprising a flexible substrate having opposing faces. Each opposing face has an adhesive deposited thereon forming a first adhesive surface and an opposing second adhesive surface. An aperture is formed in a central portion of the adhesive device.

In certain embodiments of the disclosure, a method of securing clothing is provided. The method uses an adhesive clothing securing device comprising a flexible substrate having opposing faces. Each opposing face has an adhesive deposited thereon, and an aperture is formed in a central portion of the adhesive device. The method comprises the steps of adhering one face of the adhesive device to a first surface of a fabric, and adhering the opposing face of the adhesive device to a second surface of a fabric.

In certain embodiments of the disclosure, a method of securing clothing of a person wearing the clothing using a clothing securing device is provided. The method comprises a flexible substrate having opposing faces, wherein each opposing face has an adhesive deposited thereon. An aperture is formed in a central portion of the adhesive device. The method comprises the steps of adhering one face of the adhesive device to a first surface of a fabric and adhering the opposing face of the adhesive device to a portion of skin of the person.

DETAILED DESCRIPTION OF THE DISCLOSURE

Figure 1:
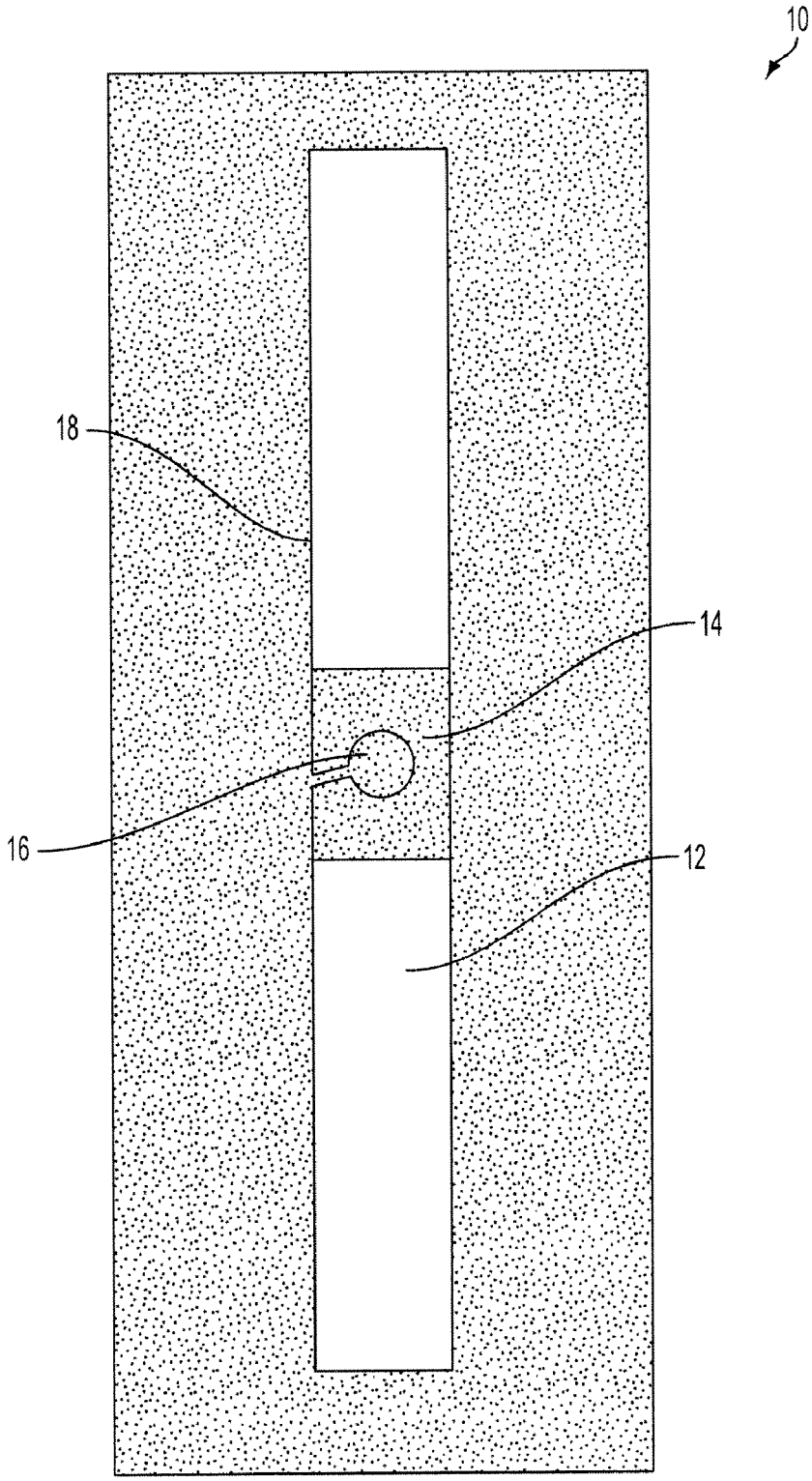
FIG. 1 PRIOR ART
FIG. 1 is a prior art illustration of a clothing securing device.

According to an embodiment of the present disclosure, an adhesive device for securing clothing 20 comprises a flexible substrate 30 having opposing faces, wherein each opposing face has an adhesive 32 deposited thereon forming a first adhesive surface 33 and an opposing second adhesive surface. An aperture 24 is formed in a central portion 25 of the adhesive device.

Figure 2:
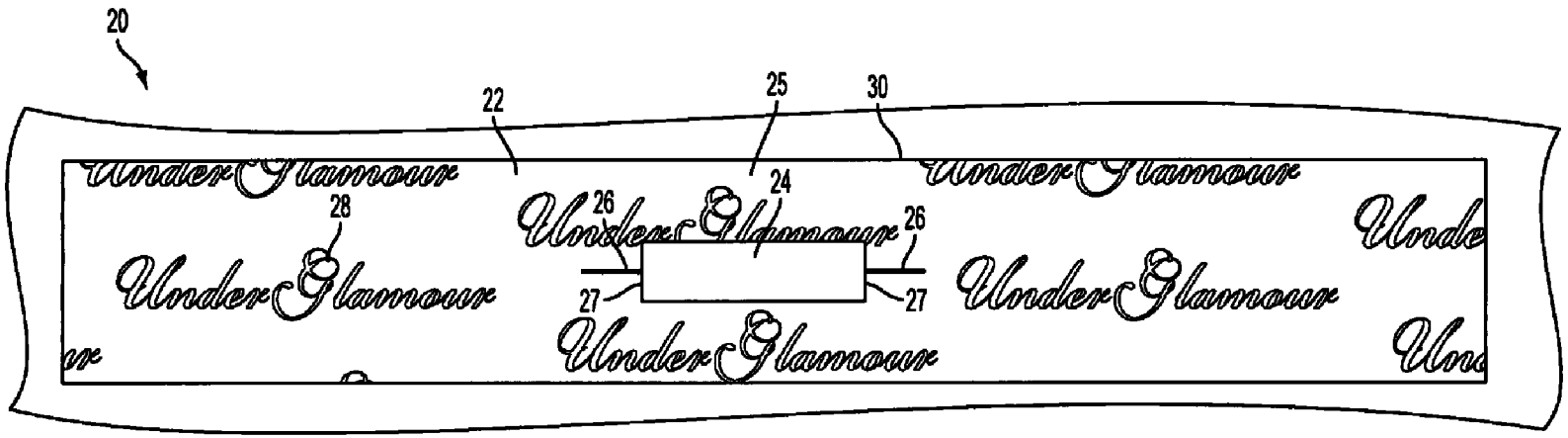
FIG. 2 is a plan view of an adhesive device for securing clothing according to an embodiment of the present disclosure.
Figure 3:
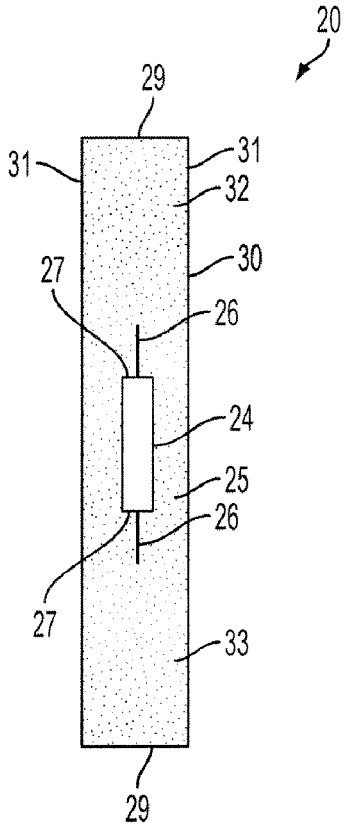
FIG. 3 is a plan view of an adhesive device for securing clothing according to an embodiment of the present disclosure.

An example of an embodiment of the present disclosure is illustrated in FIGS. 2 and 3. The adhesive device 20 of the present disclosure can be substantially rectangular-shaped. The adhesive 20 device can comprise a substantially rectangular-shaped aperture 24 in a central portion 25 of the adhesive device 20. In certain embodiments, slits 26 are formed in the adhesive device 20 extending from the width ends 27 of the aperture 24.

In certain embodiments of the present disclosure, the adhesive device 20 is transparent. In certain embodiments, the flexible substrate 30 comprises a polymer. The polymer can be a thermoplastic polymer. The thermoplastic polymer is selected from the group consisting of polyolefins, such as polyethylenes, polypropylenes, polybutylenes; polyesters; polyvinyl acetates; and blends and copolymers thereof. In certain embodiments, the adhesive 32 is selected from the group consisting of acrylates, rubbers, polyolefins, silicones, and blends and copolymers thereof.

Figure 4:
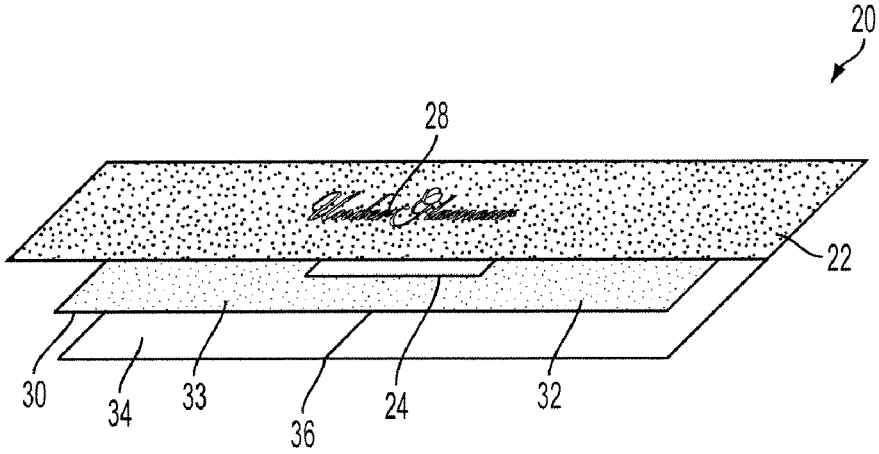
FIG. 4 is an illustration of an adhesive device for securing clothing according to an embodiment of the present invention.

In certain embodiments, the aperture 24 is a buttonhole configured to allow a button on an article of clothing to pass through the aperture 24. The aperture 24 can be completely surrounded by the flexible substrate 30 when observed in a plan view. In certain embodiments the substantially rectangular-shaped adhesive device 20 is about 3 inches in length by 0.5 inches in width. In certain embodiments of the disclosure, the adhesive device 20 further comprises a first release liner 22 overlying the first adhesive surface 33 and a second release liner 34 overlying the second adhesive surface. As shown in FIG. 4, the release liner 22 with the printing 28 is about 3.04 inches in length and 0.5 inches in width, while the release liner 34 which is treated on both sides is about 3 inches in length by 0.5 inches in width. The buttonhole aperture 24 in the center portion 25 of the tape is substantially rectangular with a dimension of about ⅝ inches in length and ⅛ inches in width. The buttonhole 24 is located about 1 3/16 inches from the top and bottom of the width ends 29 and about 1/16 inches from the length ends 31. Each slit 26 extending from the buttonhole 24 extends about ¼ inch from the width ends 29 of the buttonhole 24 and are approximately centered on the width end 29 of the buttonhole 24.

As shown in FIG. 4, in certain embodiments, the release liners 22, 34 are treated with a silicone. In certain embodiments, the first release liner 22 is treated with the silicone on a first surface facing the first adhesive surface 33 and is not treated with the silicone on a second surface opposing said first surface facing the first adhesive surface 33. In certain embodiments, a score 36 is formed across a width of the second release liner 34 at about the center of the second release liner 34. The release liners 22, 34 can be a silicone-treated Kraft-Glassine paper. There can be printing 28 on the untreated side of the first release liner 22, as shown in FIGS. 2 and 4.

In certain embodiments of the disclosure, a method of securing clothing is provided. The method uses an adhesive clothing securing device 20 comprising a flexible substrate 30 having opposing faces. Each opposing face has an adhesive 32 deposited thereon, and an aperture 24 is formed in a central portion 25 of the adhesive device 20. Adverting to FIG. 5, the method comprises the steps of adhering one face of the adhesive device 20 to a first surface of a fabric 37, and adhering the opposing face of the adhesive device 20 to a second surface of a fabric 44. In certain embodiments, the first and second surfaces of a fabric 37, 44 are different portions of the same fabric. In certain embodiments, the first and second surfaces of a fabric 37, 44 are surfaces of different pieces of fabric. One of the first and second surfaces of a fabric 37, 44 has a button 42 attached via threads 40 to the surface 37, and the method further comprises passing the button 42 through the aperture 24 formed in the adhesive clothing securing device 20.

Figure 6:
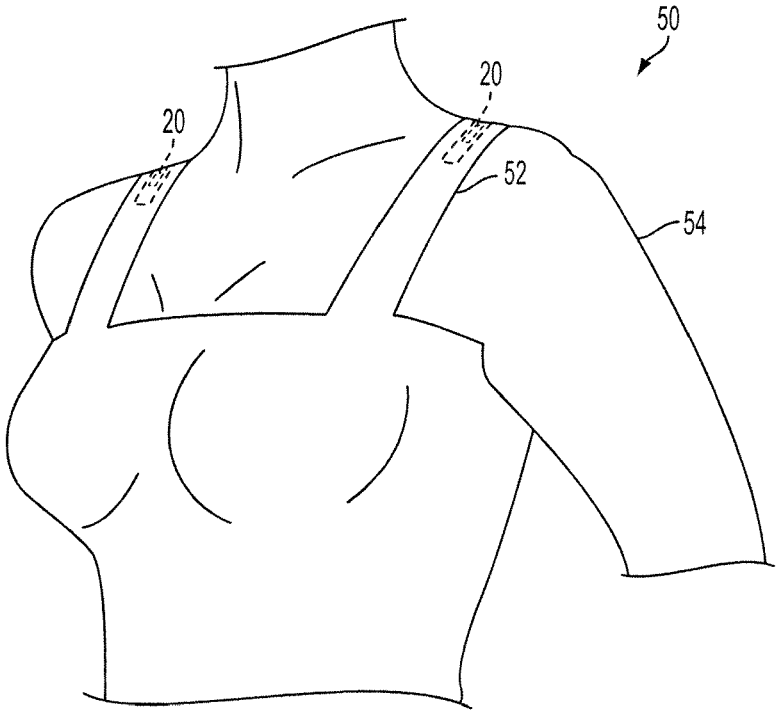
FIG. 6 illustrates the use of an adhesive device for securing clothing to skin.

In certain embodiments of the disclosure, a method of securing clothing to a person wearing the clothing using a clothing securing device 20 is provided. The method comprises a flexible substrate 30 having opposing faces, wherein each opposing face has an adhesive 32 deposited thereon. An aperture 24 is formed in a central portion 25 of the adhesive device 20. As illustrated in FIG. 6, the method comprises the steps of adhering one face of the adhesive device 20 to a first surface of a fabric 52, such as a strap, and adhering the opposing face of the adhesive device to a portion of skin 54 of the person 50.

In certain embodiments of the present disclosure, the adhesive 32 can be an acrylate. The acrylate can be a hypoallergenic, pressure sensitive, releasable adhesive. In certain embodiments the adhesive is a medical grade adhesive, which can safely adhere to skin 54 and woven and non-woven fabrics 52.

Advantages and benefits of adhesive devices according to embodiments of the present disclosure include:

1. The adhesive device 20 according to the present disclosure is less visible under clothing than prior art devices. There are no "unsightly" plastic connectors visible from a side view.
2. The adhesive device 20 according to the present disclosure can adhere directly to shirt fabric and can be completely concealed.
3. The adhesive device 20 according to the present disclosure surrounds the entire button 42 affecting a more secure seal of the two faces of shirt fabric 37, 44.
4. In certain embodiments according to the present disclosure, the entire surface of the adhesive device 20 facing the fabric is coated with adhesive 32, resulting in an increased bond with fabric faces 37, 44, unlike other adhesive clothing securing devices which have a plastic connector 14 with no adhesive.
5. In certain embodiments according to the present disclosure, the adhesive device 20 is thinner and sits smoother under clothing than other adhesive clothing securing devices having protruding or rigid plastic connectors 14.
6. In certain embodiments according to the present disclosure, the adhesive device 20 is designed to accommodate all button 42 sizes, unlike other adhesive clothing securing devices 10 which are limited by the relatively smaller-sized notch 16 formed in the plastic connector 14.
7. In certain embodiments according to the present disclosure, the adhesive device 20 is certified 100% medical grade hypo-allergenic, unlike other adhesive clothing securing devices 10 that comprise a central PVC connector 14, which is environmentally harmful.
8. The adhesive device 20 according to the present disclosure is multifunctional and can be used for purposes other than shirt closure, i.e.—securing dropped hems.
9. The adhesive device 20 according to the present disclosure can be used for securing buttons on skirts, pants and other items of clothing due to the flexible material used in the substrate 30, unlike other adhesive clothing securing devices 10, which are limited to one dimensional applications because the central PVC connector 14 is rigid.
10. The adhesive device 20 according to the present disclosure has elastic properties which allow it to conform to stretch fabrics, unlike other adhesive clothing securing devices 10 which comprise a rigid central connector 14.

In certain embodiments according to the present disclosure, the adhesive device 20 comprises a two-sided tape available from 3M. In certain embodiments, the tape is 3M Double-Coated Medical Tape #1522. The tape can comprise a 0.08 mm thick transparent polyethylene film coated on both sides with hypoallergenic, pressure sensitive, releasable acrylate adhesive designed for medical use and capable of adhering safely to skin and woven and non-woven surfaces. The thickness of the tape including the substrate and adhesive is 0.16 mm in certain embodiments. The tape can be backed on one side by a release liner comprising a bleached 80 lb. Kraft-Glassine paper, such as 0.11 mm thick HP Smith Easy Release paper treated with silicone and printed on the opposing side, and the tape is backed on the other side by bleached 80 lb. Kraft-Glassine paper, such as 0.11 mm thick Smith Easy Release paper treated with silicone on both sides and the paper is scored on one side.

Figure 5:
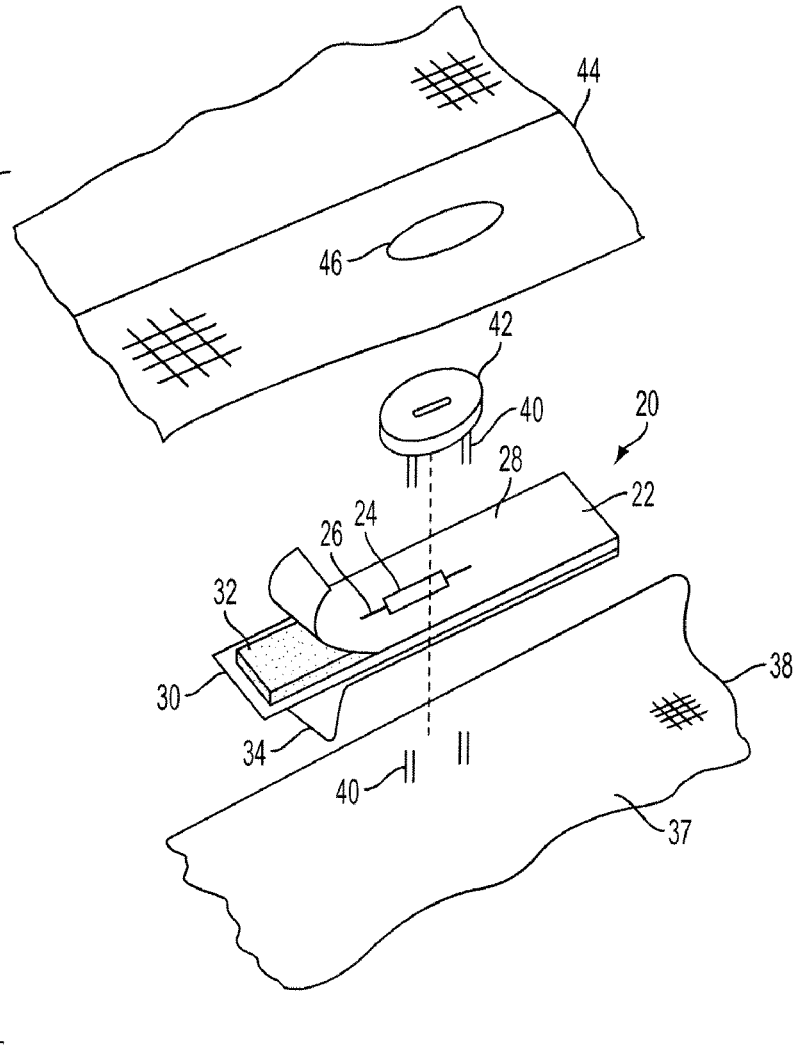
FIG. 5 illustrates the use of an adhesive device for securing the closure of a shirt.

One use for the adhesive device 20 of the present disclosure is to keep button-front shirts or blouses (so called "Oxford Shirts") closed by adhering the side of the shirt placket 38 closest to the body and containing the button 42 to the opposing placket 44 containing the buttonhole 46. as shown in FIG. 5. The adhesive device prevents gaps in between buttons on shirts and blouses which can cause potential embarrassment to the wearer.

In one embodiment of the present disclosure, a method of using an adhesive device 20 comprises the steps of holding the adhesive device 20 with the printed liner 22 facing up. While holding the adhesive device 20 by the sides, pull the adhesive device 20 apart slightly to separate the slits 24, and peel away the printed liner 22. The adhesive device 20 is aligned with the buttonhole aperture 24 over a shirt button 42, and the adhesive device 20 is placed onto a shirt 38 with the buttonhole 24 positioned around the button 42 where the adhesive device 20 is situated between the bottom of the button 42 and the shirt fabric 38. The adhesive device 20 is firmly pressed against the shirt fabric 38 to secure the adhesive device 20 in place and the scored liner 34 is subsequently peeled away. The opposing side of the shirt placket 44 is fastened with the corresponding buttonhole 46 around the button 42 and firmly pressing in place securing the adhesive device 20 between the two opposing sides of the shirt placket

37, 44. Thus securing the shirt placket closed and effectively eliminating gaps between buttons.

The adhesive device 20 according to the present disclosure can be used to attach one article of clothing to another, to close gaps which can be formed in opposing portions of shirts or pants between buttons, as shown if FIG. 5, to secure dropped hems and securing buttons. Further, the adhesive device 20 can be used to and attach clothing 52 to skin 54, such as holding a shirt strap 52 to a wearer's shoulder 54, as shown in FIG. 6.

The embodiments illustrated in the instant disclosure are for illustrative purposes only. They should not be construed to limit the claims. As is clear to one of ordinary skill in the art, the instant disclosure encompasses a wide variety of embodiments not specifically illustrated herein. While the compositions and methods of this disclosure have been described in terms of exemplary embodiments, it will be apparent to those of skill in the art that variations may be applied to the compositions and methods and in the steps or in the sequence of steps of the method described herein without departing from the concept, spirit and scope of the invention.

What is claimed is:

1. An adhesive device for securing clothing comprising:

a flexible substrate having opposing faces, wherein each opposing face has an adhesive deposited thereon forming a first adhesive surface and an opposing second adhesive surface, a substantially rectangular-shaped aperture formed in a central portion of the adhesive device, wherein the aperture is completely surrounded by the flexible substrate when observed in a plan view; and a pair of slits extending substantially perpendicular from opposing sides of the substantially rectangular-shaped aperture, one slit extending from each of opposing width sides, wherein said slits are positioned substantially at the center of the opposing sides.

2. The adhesive device according to claim 1, wherein the adhesive device is transparent.

3. The adhesive device according to claim 1, wherein the flexible substrate comprises a polymer.

4. The adhesive device according to claim 3, wherein the polymer is a thermoplastic polymer.

5. The adhesive device according to claim 4, wherein the thermoplastic polymer is selected from the group consisting of polyethylenes, polypropylenes, polybutylenes, polyesters, polyvinyl acetates, and blends and copolymers thereof.

6. The adhesive device according to claim 1, wherein the adhesive is selected from the group consisting of acrylates, rubbers, polyolefins, silicones, and blends and copolymers thereof.

7. The adhesive device according to claim 1, wherein the aperture is configured to allow a button on an article of clothing to pass through the aperture.

8. The adhesive device according to claim 1, further comprising a first release liner overlying the first adhesive surface and a second release liner overlying the second adhesive surface.

9. The adhesive device according to claim 8, wherein the release liners are treated with a silicone.

10. The adhesive device according to claim 9, wherein the first release liner is treated with the silicone on a first surface facing the adhesive layer and is not treated with the silicone on a second surface opposing said first surface facing the adhesive layer.

11. The adhesive device according to claim 9, wherein a score is formed across a width of the second release liner at about the center of the second release liner.

12. A method of securing clothing using an adhesive clothing securing device comprising a flexible substrate having opposing faces, wherein each opposing face has an adhesive deposited thereon, a substantially rectangular-shaped aperture is formed in a central portion of the adhesive device, wherein the aperture is completely surrounded by the flexible substrate when observed in a plan view and a pair of slits extending substantially perpendicular from opposing sides of the substantially rectangular-shaped aperture, one slit extending from each of opposing width sides, wherein said slits are positioned substantially at the center of the opposing sides, comprising the steps of:

adhering one face of the adhesive device to a first surface of a fabric; and adhering the opposing face of the adhesive device to a second surface of a fabric.

13. The method of securing clothing according to claim 12, wherein the first and second surfaces are different portions of the same fabric.

14. The method of securing clothing according to claim 12, wherein the first and second surfaces are surfaces of different pieces of fabric.

15. The method of securing clothing according to claim 12, wherein one of said first and second surfaces of a fabric has a button attached to said surface, the method further comprising passing said button through the aperture formed in said adhesive clothing securing device.

16. A method of securing clothing of a person wearing said clothing using a clothing securing device comprising a flexible substrate having opposing faces, wherein each opposing face has an adhesive deposited thereon, a substantially rectangular-shaped aperture is formed in a central portion of the adhesive device, wherein the aperture is completely surrounded by the flexible substrate when observed in a plan view; and a pair of slits extending substantially perpendicular from opposing sides of the substantially rectangular-shaped aperture, one slit extending from each of opposing width sides, wherein said slits are positioned substantially at the center of the opposing sides comprising the steps of:

adhering one face of the adhesive device to a first surface of a fabric; and adhering the opposing face of the adhesive device to a portion of skin of said person.

* * * * *